US009721703B2

(12) United States Patent
Hiller et al.

(10) Patent No.: US 9,721,703 B2
(45) Date of Patent: Aug. 1, 2017

(54) WILDLIFE GUARD APPARATUS, MODULAR SYSTEMS AND METHODS FOR USING THE SAME

(71) Applicant: Tyco Electronics Corporation, Berwyn, PA (US)

(72) Inventors: Laura Jackson Hiller, Cary, NC (US); Stephen M. Parker, Greensboro, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/142,928

(22) Filed: Apr. 29, 2016

(65) Prior Publication Data

US 2016/0351305 A1 Dec. 1, 2016

Related U.S. Application Data

(60) Provisional application No. 62/166,864, filed on May 27, 2015.

(51) Int. Cl.
*H01B 17/00* (2006.01)

(52) U.S. Cl.
CPC ..... *H01B 17/00* (2013.01)

(58) Field of Classification Search
USPC ..... 174/138 F, 5 R, 140 H
See application file for complete search history.

(56) References Cited

U.S. PATENT DOCUMENTS

| | | | |
|---|---|---|---|
| 4,453,353 | A | 6/1984 | Killop et al. |
| 4,845,307 | A | 7/1989 | Cumming et al. |
| 5,308,923 | A | 5/1994 | Puigcerver et al. |
| 6,005,196 | A | 12/1999 | Spillyards |

(Continued)

FOREIGN PATENT DOCUMENTS

| | | |
|---|---|---|
| EP | 1 052 657 A2 | 11/2000 |
| WO | WO 01/63625 A2 | 8/2001 |

OTHER PUBLICATIONS

"BCAC Bushing Connection Animal Cover," Tyco Electronics PII-55169, Rev AA, PCN F03268-000, Sep. 11, 2001, 6 pages.

(Continued)

*Primary Examiner* — Dhirubhai R Patel
(74) *Attorney, Agent, or Firm* — Myers Bigel, P.A.

(57) ABSTRACT

A wildlife guard apparatus for an electrical insulator body includes at least one guard assembly. Each guard assembly includes a guard member and a base wall member secured to the guard member. The at least one guard assembly is configured or configurable to form an enclosure defining a chamber. In the enclosure configuration, the at least one guard member defines an end opening communicating with the chamber and the at least one base wall member extends across the end opening to close at least a portion thereof. The enclosure is configured to receive the insulator body such that the insulator body includes a first portion and a second portion, the first portion extending through the end opening and adjacent the at least one base wall member, and the second portion being disposed in the chamber. The at least one guard member is formed of a first material and the at least one base wall member is formed of a second material that is softer than the first material.

25 Claims, 9 Drawing Sheets

(56) References Cited

U.S. PATENT DOCUMENTS

| | | | | |
|---|---|---|---|---|
| D435,055 | S | 12/2000 | Puigcerver et al. | |
| 6,248,956 | B1 | 6/2001 | Cook et al. | |
| 6,255,597 | B1 * | 7/2001 | Bowling | H01B 17/00 174/138 F |
| 6,291,774 | B1 | 9/2001 | Williams | |
| 6,303,870 | B1 | 10/2001 | Nazaryan et al. | |
| 6,359,228 | B1 | 3/2002 | Strause et al. | |
| 6,486,785 | B1 | 11/2002 | Hoth | |
| 6,770,809 | B1 | 8/2004 | De France | |
| 6,995,313 | B1 * | 2/2006 | Barnett | H01B 17/00 174/138 F |
| 7,297,869 | B2 | 11/2007 | Hiller et al. | |
| D595,804 | S | 7/2009 | Tollefson et al. | |
| 7,622,668 | B1 | 11/2009 | Tollefson et al. | |
| 8,426,729 | B2 | 4/2013 | Hiller et al. | |

OTHER PUBLICATIONS

"BCAC 8D/14-01, BCAC 7D/10-01 Bushing Cover," Tyco Electronics PCN D 19792-000, Jul. 15, 2008, 4 pages.

"Energy Division—BCAC Bushing Connection Animal Cover," Tyco Electronics, Mar. 2009, 2 pages.

"Insulation Enhancement—Substation Asset Protection for Wildlife—BCAC-5D/8," http://energy.tycoelectronics.com/index.asp?act=page&pag_id=2&prl_id=5&pls_id=29&p . . . Aug. 31, 2009.

"Insulation Enhancement—Substation Asset Protection for Wildlife—BCAC-8D/14," http://energy.tycoelectronics.com/index.asp?act=page&pag_id=2&prl_id=5&pls_id=29&p . . . Aug. 31, 2009.

"Therm-A Guard® Wildlife Protector," 31, 2009. http://www.therm-a-guard.com/indexc.html, Aug. 31, 2009.

* cited by examiner

WILDLIFE GUARD APPARATUS, MODULAR SYSTEMS AND METHODS FOR USING THE SAME

RELATED APPLICATION(S)

The present application claims the benefit of and priority from U.S. Provisional Patent Application No. 62/166,864, filed May 27, 2015, the disclosure of which is incorporated herein by reference in its entirety.

FIELD OF THE INVENTION

The present invention relates to protective guards and, more particularly, to wildlife guards for power distribution lines and associated insulators.

BACKGROUND OF THE INVENTION

Electrical equipment, such as power transmission lines, insulators, surge arrestors, switchgear and transformers (e.g., operating at voltages in excess of 1 kV and particularly in excess of 10 kV, such voltages hereinafter being referred to as "high voltage"), often have parts thereof or parts associated therewith that are not insulated from the surrounding air. Thus, an exposed portion of such equipment can be at high voltage and be longitudinally separated from another portion at low voltage, for example at earth potential. The exposed high voltage portion may be physically supported by an insulator, for example when an overhead power line is mounted on an insulator that spaces it from a supporting tower that is itself at earth potential, or for example when a high voltage cable is terminated at a bushing or switchgear whose metal housing is at earth potential. In such instances outdoors, larger wildlife such as squirrels and birds with large wingspans may be big enough to form a direct bridge (i.e., an electrical short circuit) between the high voltage equipment and earth potential, with serious, usually fatal, consequences for themselves and often with serious consequences for the electrical equipment and the supply of electrical power—usually at least a fuse is actuated or a circuit breaker triggered such that the power supply is interrupted.

One known solution to the foregoing problem is to install a wildlife guard that may be referred to as a "squirrel guard". Typically, a wildlife guard includes one or more parts forming a disk with an aperture. The wildlife guard is mounted on an insulator (e.g., between sheds) such that the disc extends radially outwardly from the insulator beyond the sheds. The wildlife guard substantially increases the distance from earth potential to the high voltage equipment so that wildlife are prevented from simultaneously making contact with each of, and thereby bridging, earth potential and the high voltage equipment. Another type of wildlife guard includes a pair of pivotally connected cover portions that, when closed, form a hollow body that enclose an insulator.

SUMMARY

According to embodiments of the invention, a wildlife guard apparatus for an electrical insulator body includes at least one guard assembly. Each guard assembly includes a guard member and a base wall member secured to the guard member. The at least one guard assembly is configured or configurable to form an enclosure defining a chamber. In the enclosure configuration, the at least one guard member defines an end opening communicating with the chamber and the at least one base wall member extends across the end opening to close at least a portion thereof. The enclosure is configured to receive the insulator body such that the insulator body includes a first portion and a second portion, the first portion extending through the end opening and adjacent the at least one base wall member, and the second portion being disposed in the chamber. The at least one guard member is formed of a first material and the at least one base wall member is formed of a second material that is softer than the first material.

According to method embodiments of the invention, a method for covering an electrical insulator body includes providing a wildlife guard apparatus that includes at least one guard assembly. Each guard assembly includes a guard member and a base wall member secured to the guard member. The at least one guard assembly is configured or configurable to form an enclosure defining a chamber. In the enclosure configuration, the at least one guard member defines an end opening communicating with the chamber and the at least one base wall member extends across the end opening to close at least a portion thereof. The method further includes mounting the enclosure on the insulator body such that the insulator body includes a first portion extending through the end opening and adjacent the at least one base wall member and a second portion disposed in the chamber. The at least one guard member is formed of a first material and the at least one base wall member is formed of a second material that is softer than the first material.

According to further embodiments of the invention, a protected electrical equipment installation includes an electrical insulator body and a wildlife guard apparatus. The wildlife guard apparatus includes at least one guard assembly. Each guard assembly includes a guard member and a base wall member secured to the guard member. The at least one guard assembly is configured or configurable to form an enclosure defining a chamber. In the enclosure configuration, the at least one guard member defines an end opening communicating with the chamber and the at least one base wall member extends across the end opening to close at least a portion thereof. The enclosure is mounted on the insulator body such that the insulator body includes a first portion extending through the end opening and adjacent the at least one base wall member and a second portion disposed in the chamber. The at least one guard member is formed of a first material and the at least one base wall member is formed of a second material that is softer than the first material.

Further features, advantages and details of the present invention will be appreciated by those of ordinary skill in the art from a reading of the figures and the detailed description of the embodiments that follow, such description being merely illustrative of the present invention.

DETAILED DESCRIPTION OF EMBODIMENTS OF THE INVENTION

Figure 1:
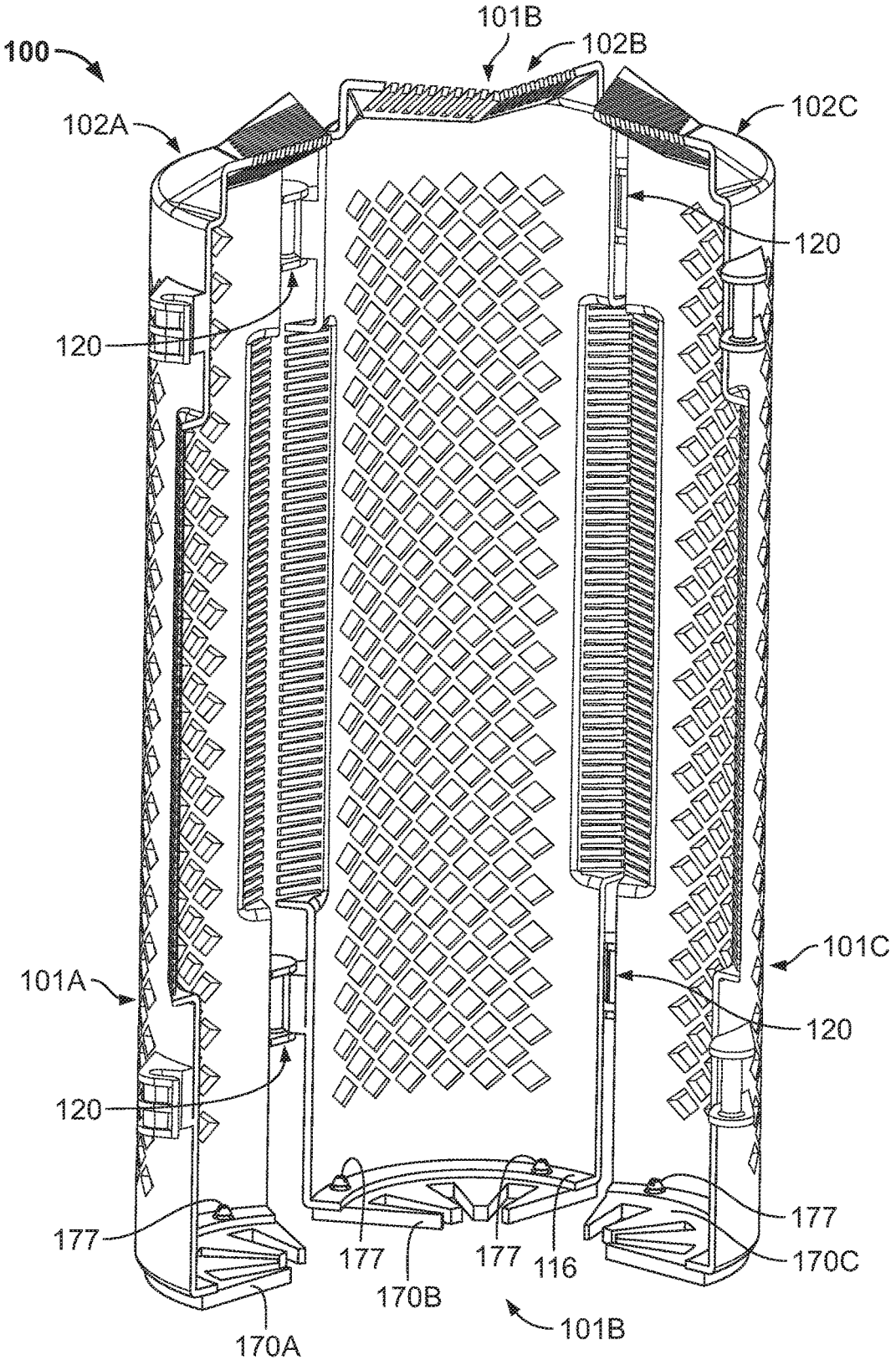
FIG. 1 is a top, front perspective view of a wildlife guard apparatus according to embodiments of the present invention in an open position.
Figure 2:
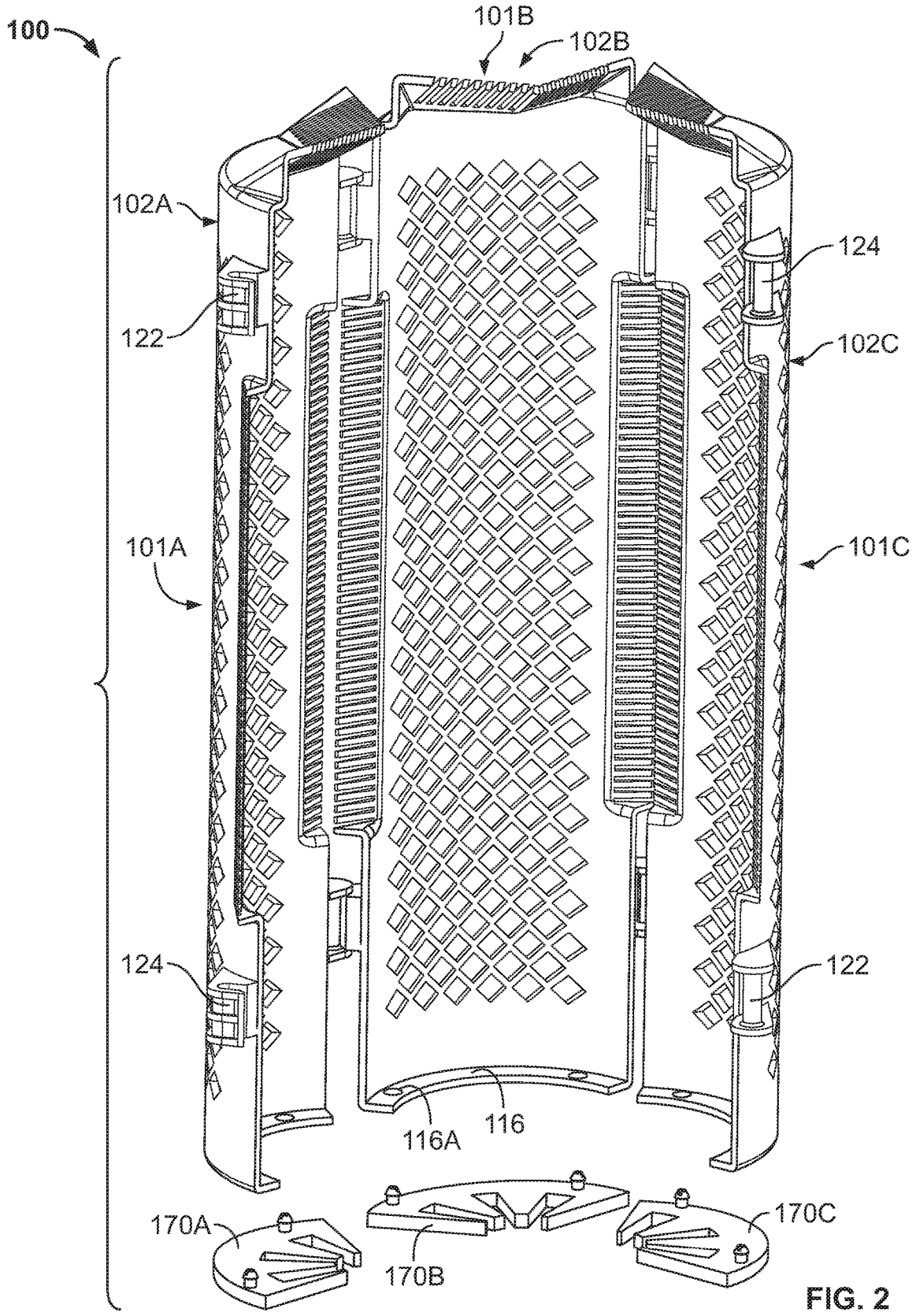
FIG. 2 is a partially exploded, top, front perspective view of the wildlife guard apparatus of FIG. 1 in the open position.
Figure 3:
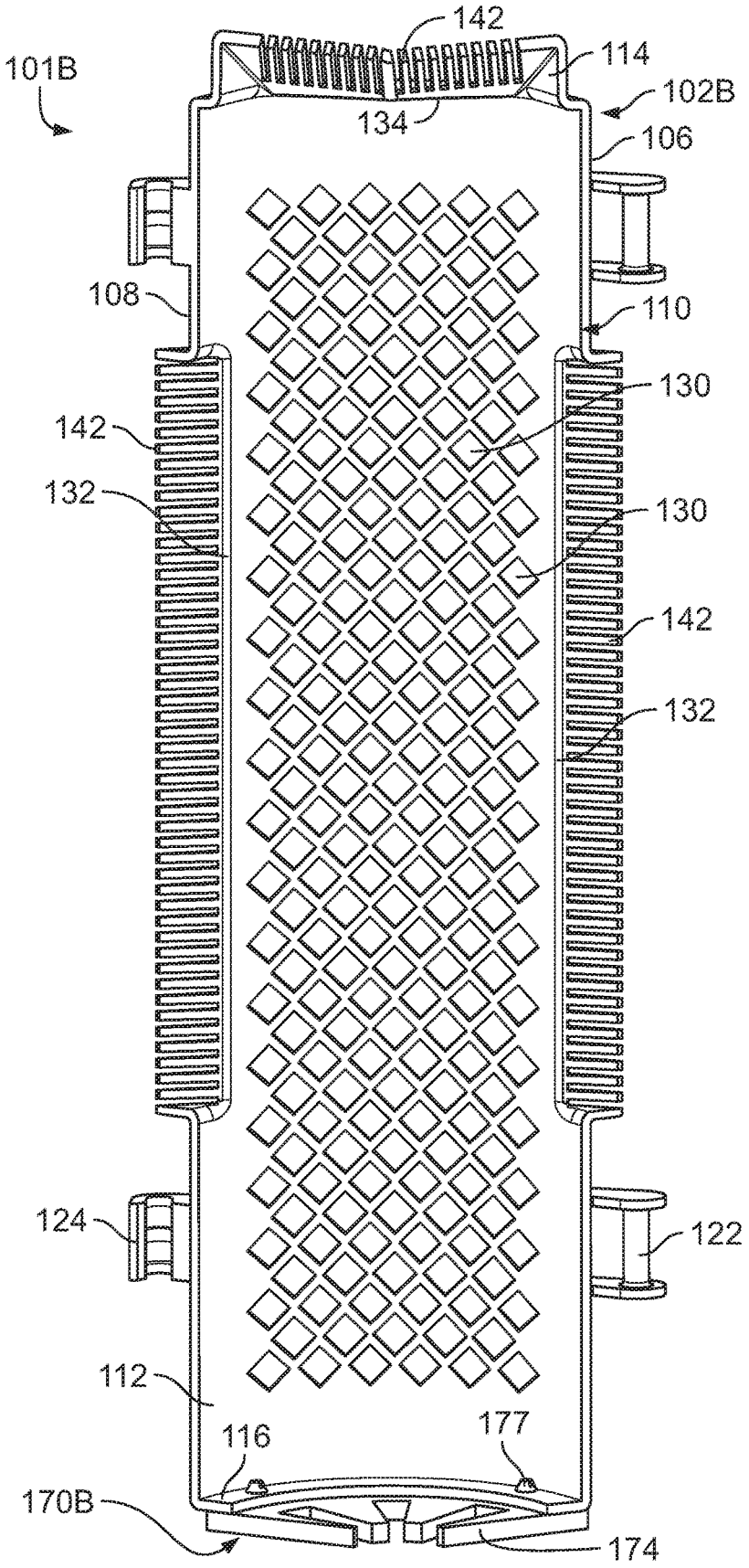
FIG. 3 is a front plan view of a guard assembly forming a part of the wildlife guard apparatus of FIG. 1.
Figure 4:
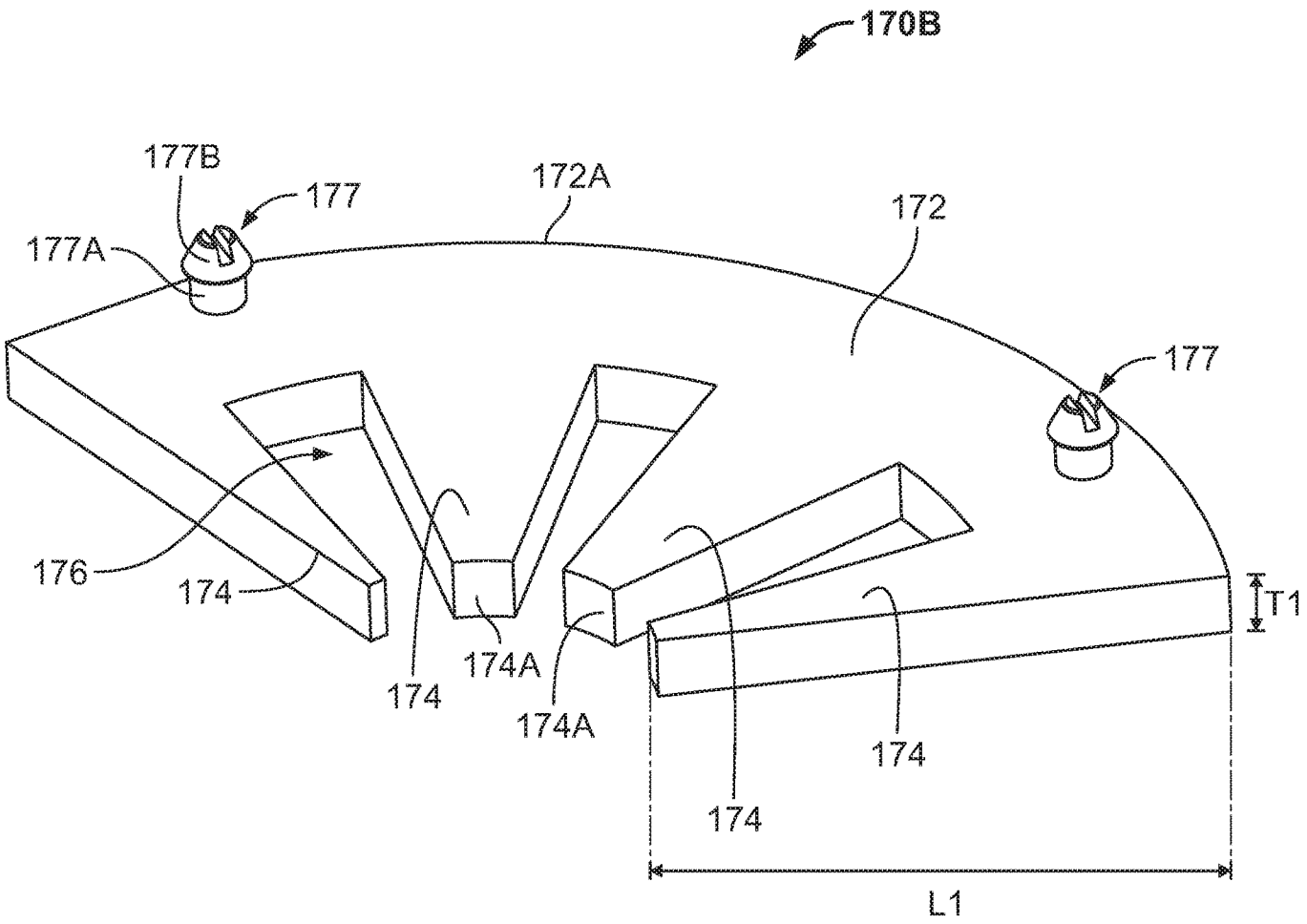
FIG. 4 is a top, front perspective view of a base wall member forming a part of the wildlife guard apparatus of FIG. 1.
Figure 5:
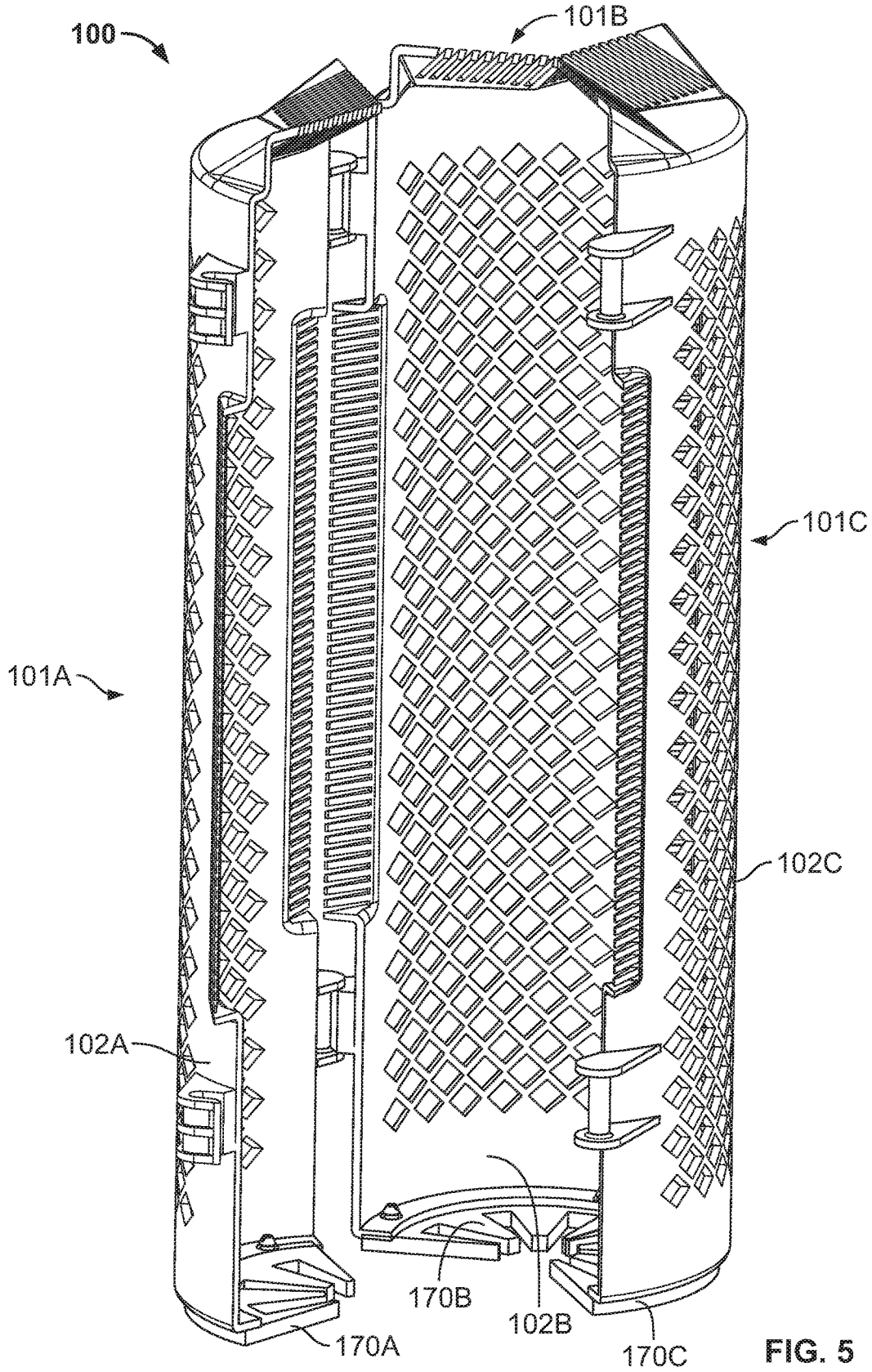
FIG. 5 is top, front perspective view of the wildlife guard apparatus of FIG. 1 in a partially closed position.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

As used herein, "monolithic" means an object that is a single, unitary piece formed or composed of a material without joints or seams.

Figure 6:
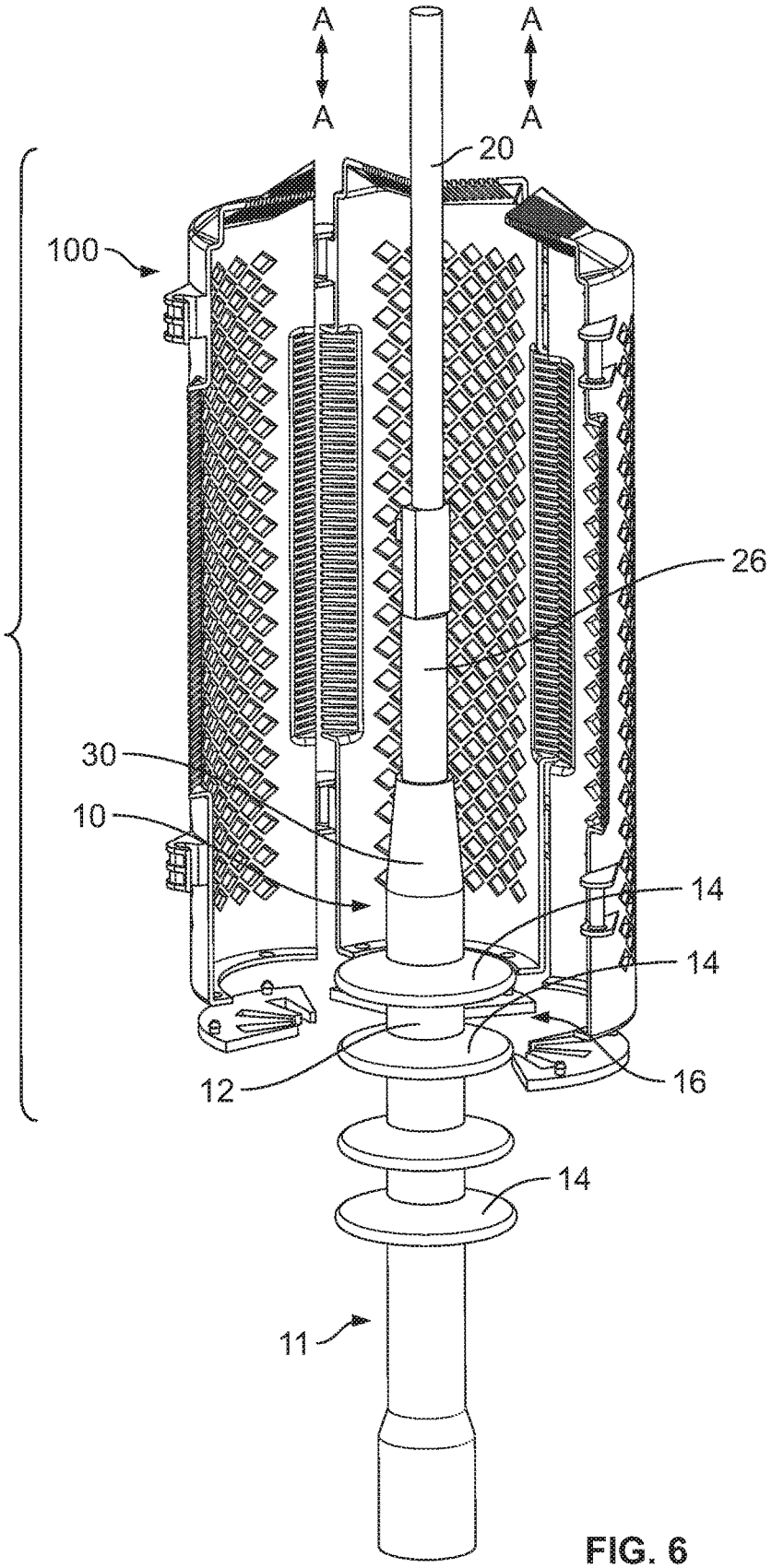
FIG. 6 is a partially exploded, top, front perspective view of the wildlife guard apparatus of FIG. 1 in the open position and placed about an electrical cable termination for installation thereon.
Figure 7:
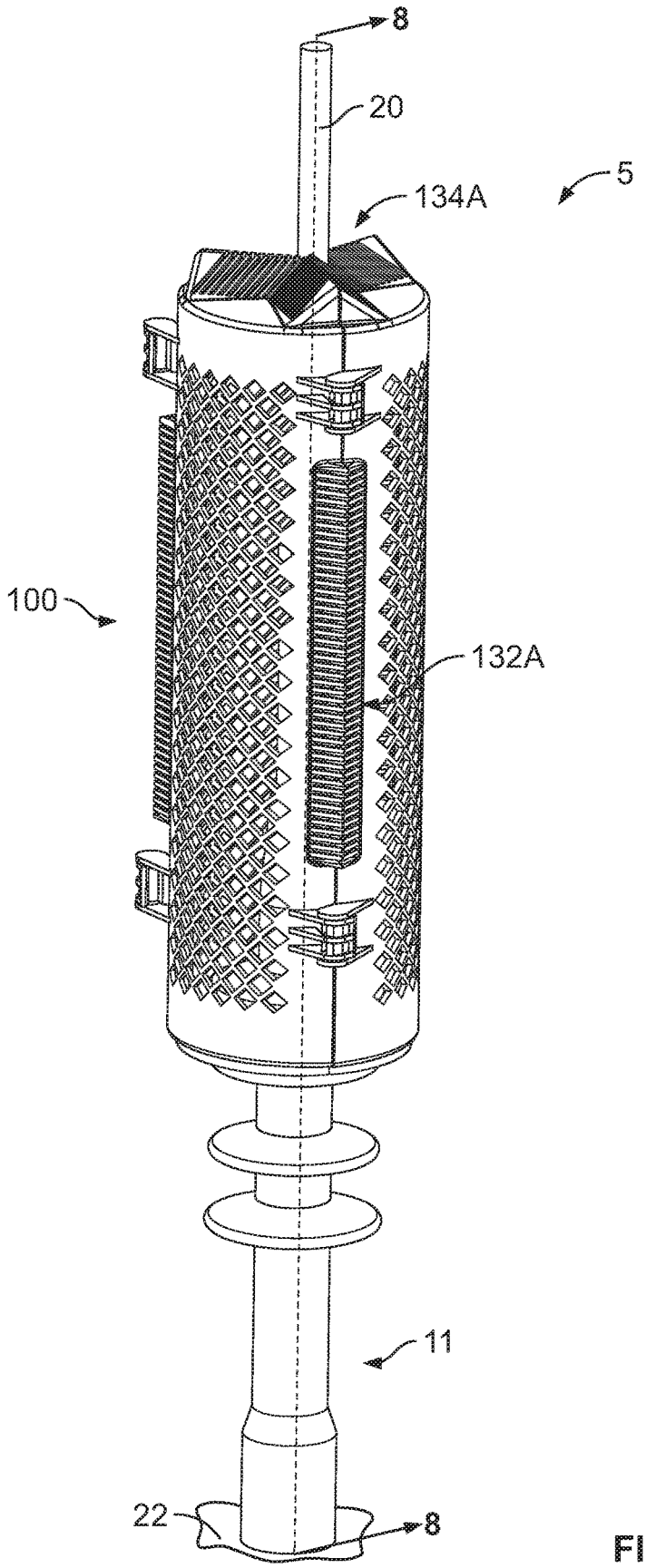
FIG. 7 is top, front perspective view of the wildlife guard apparatus of FIG. 1 installed on the electrical cable termination in a closed position.
Figure 8:
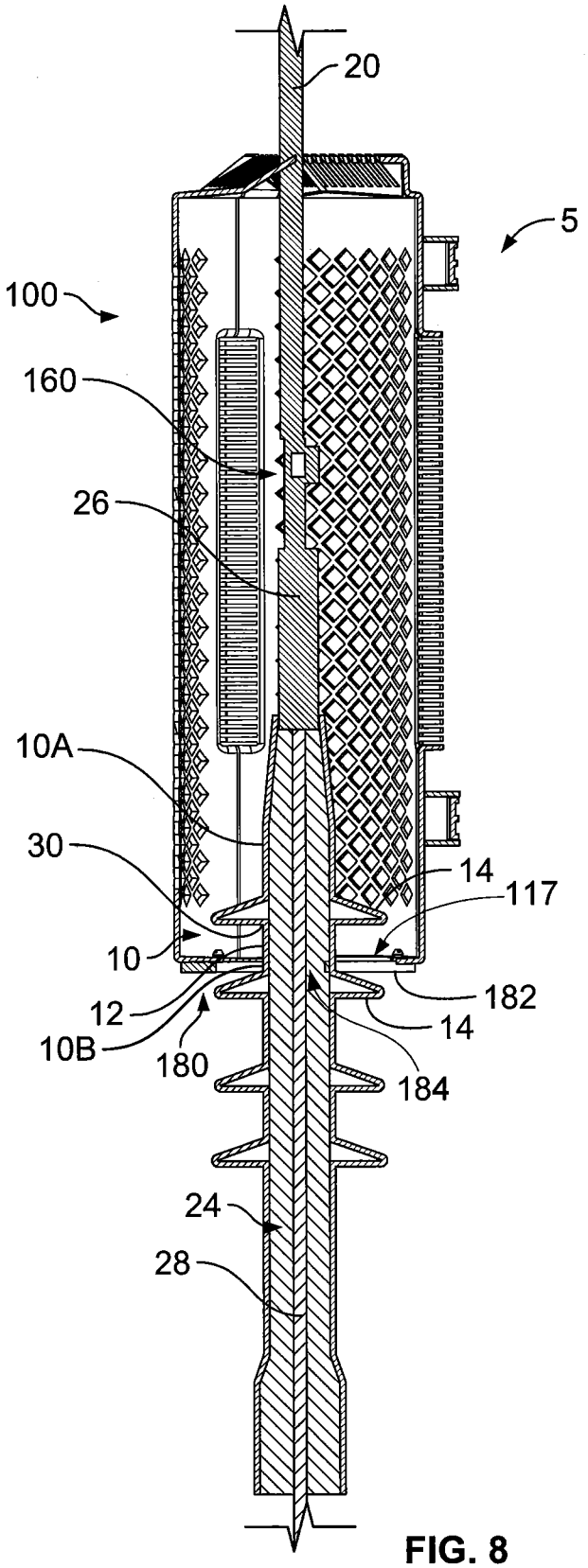
FIG. 8 cross-sectional view of the wildlife guard apparatus of FIG. 1 installed on the electrical cable termination taken along the line 8-8 of FIG. 7.

With reference to FIGS. 1-8, a wildlife guard apparatus 100 according to embodiments of the present invention is shown therein. The wildlife guard apparatus 100 may be used with an electrical insulator body 10 including an electrical insulator sleeve 30 forming a part of an electrical cable termination 11 as shown in FIG. 6 to form protected electrical equipment 5 (FIG. 8). The electrical cable termination 11 is mounted on a terminal end of an electrical cable 24. In the illustrated embodiment, an energized electrical conductor 20 extends from the top of the electrical cable termination 11. The electrical cable termination 11 may be mounted on a support 22. The insulator body 10, which is formed of an electrically insulating material, electrically shields the conductor 20 from the support 22 and/or other electrically conductive components (e.g., which may be at earth potential). When installed on the electrical cable termination 11, the wildlife guard apparatus 100 extends radially outwardly from the insulator body 10 and serves to enlarge or extend the shortest distance between the components at significantly different electrical potential (i.e., the conductor 20 and the support 22) that can be bridged by wildlife such as squirrels or large birds. That is, the wildlife guard apparatus 100 has a diameter greater than that of the insulator body 10 so that the wildlife guard apparatus 100 provides an effective barrier or obstacle to wildlife prostrating themselves from earth to high voltage.

Turning to the wildlife guard apparatus 100 in more detail and with reference to FIG. 1, the wildlife guard apparatus 100 includes a first guard member 102A, a second guard member 102B and a third guard member 102C. The wildlife guard apparatus 100 further includes a first inner or base wall member 170A, a second inner or base wall member 170B, and a third inner or base wall member 170C. The wall members 170A-C are secured to the guard members 102A, 102B and 102C, respectively, as discussed below to form guard assemblies 101A, 101B and 101C, respectively.

The guard assemblies 101A-C are serially connected or interlocked with one another to enable the guard assemblies 101A-C to move relative to one another between an open position to receive the insulator body 10 and a closed position to cover and remain securely mounted on the insulator body 10. According to some embodiments and as illustrated in the drawings, the guard assemblies 101A-C can be pivoted or rotated about hinges 120 from an open position (as shown in FIGS. 1 and 6) to a closed position (as shown in FIGS. 7 and 8) as discussed hereinbelow.

The guard assemblies 101A-C may be identical to one another in certain functional aspects. According to some embodiments and as illustrated, the guard assemblies 101A-C are substantially identical to one another in shape. The guard assembly 101B is exemplary and is shown in further detail in FIG. 3. The guard assembly 101B will be described in further detail hereinbelow; however, it will be appreciated that this description (as well as the applied reference numbers) likewise apply to the guard assemblies 101A and 101C.

The guard members 102A-C may be identical to one another in certain functional aspects. According to some embodiments and as illustrated, the guard members 102A-C are substantially identical to one another in shape. The guard member 102B is exemplary and is shown in further detail in FIG. 3. The guard member 102B will be described in further detail hereinbelow; however, it will be appreciated that this description (as well as the applied reference numbers) likewise apply to the guard members 102A and 102C.

The guard member 102B of the guard assembly 101B includes a shell body 110. The shell body 110 includes a sidewall 112, an outer wall 114 and an inner end lip or flange 116. The walls 112, 114 and flange 116 define opposed elongated side edges 106, 108. Side notches 132 are defined in each side edge 106, 108. An outer notch 134 is defined in the outer wall 114. Retention holes 116A are defined in the flange 116.

Deflectable walls 142 extend across the notches 132, 134. The deflectable walls 142 may be frangible membranes or resilient, flexible fingers as shown, for example.

Handle mount holes may be provided in the sidewall 112 or elsewhere to receive and secure a supplemental handle member, for example.

A plurality of window apertures or openings 130 are defined in the sidewall 112. The window openings 130 can collectively form a window for viewing the contents of the wildlife guard apparatus 100 when installed. According to some embodiments, the window openings 130 cover a majority of the sidewall 112. More or fewer window openings 130 may be provided and the window openings 130 can have a different shape or shapes than that shown.

A pair of integral hinge features 122 of a first or male type extend laterally from the shell body 110 adjacent and beyond the side edge 106 and a pair of integral hinge features 124 of a second or female type extend laterally from the shell body 110 adjacent and beyond the side edge 108. The hinge features 124 are configured to snap-fit onto the hinge features 122 to cooperatively form respective ones of the hinges 120. The guard member 102B and, likewise, the guard members 102A and 102C may therefore be described as each having a hermaphroditic connectability or a hermaphroditic integral hinge connector set.

The base wall members 170A-C may be identical to one another in certain functional aspects. According to some embodiments and as illustrated, the base wall members 170A-C are substantially identical to one another in shape. The base wall member 170B is exemplary and is shown in further detail in FIG. 4. The base wall member 170B will be described in further detail hereinbelow; however, it will be appreciated that this description (as well as the applied reference numbers) likewise apply to the base wall members 170A and 170C.

The base wall member 170B includes an outer body 172, a plurality of tines, extensions or fingers 174 integral with the body 172, and a plurality of coupling features 177 integral with the body 172. In some embodiments and as shown, the body 172 and the fingers 174 collectively define a substantially planar plate or disk. In some embodiments and as illustrated, the base wall member 170B has a general overall shape of a wedge. In some embodiments and as illustrated, the base wall member 170B has a general overall shape of a truncated (at its inner end) sector of a circle. In some embodiments, the base wall member 170B has a general overall shape of a truncated (at its inner end) sector of a circle having an angle in the range of from about 80 to 130 degrees.

The body 172 has an arcuate outer peripheral edge 172A. In some embodiments, the arcuate outer peripheral edge 172A is uniform and defines a section of a circle.

The fingers 174 project or extend radially inwardly from the inner edge of the body 172 to respective inner terminal ends 174A. The ends 174A collectively define an inner peripheral edge 174B. The fingers 174 are circumferentially distributed and spaced apart to define radially extending, circumferentially spaced apart slots 176 therebetween. The fingers 174 are each tapered from the body 172 to their terminal ends 174A.

The coupling features 177 each include a post 177A projecting axially upwardly from the body 172 to an enlarged head 177B.

According to some embodiments, the body 172 and fingers 174 have a thickness T1 (FIG. 4) in the range of from about 0.1 to 0.25 inch. According to some embodiments, the thickness T1 is in the range of from about 6 to 15 percent of the radial length L1 (FIG. 4) of the base wall member 170B (i.e., the distance from the outer edge 172A to the inner edge 174B).

The base member 170B is secured or affixed to the guard member 102B to form the guard assembly 101B. More particularly, the coupling features 177 are snapped in or inserted through and interlock with the holes 116A in the flange 116 of the guard member 102B. The coupling features 177 are retained in the holes 116A by their heads 177B.

The guard members 102A-C may be formed of any suitable electrically insulative material. According to some embodiments, the guard members 102A-C are formed of a rigid or semi-rigid polymeric material. The material may be weather resistant. According to some embodiments, the guard members 102A-C are formed of a track resistant, insulating grade, UV stable polymer. According to some embodiments, the guard members 102A-C are formed of a rigid or semi-rigid polymeric material selected from the group consisting of polyolefins.

The guard members 102A-C may be formed of the same or different materials. According to some embodiments, the guard members 102A-C are each integrally formed and, according to some embodiments, each are unitarily molded. According to some embodiments, the guard members 102A-C are each unitarily injection molded. In some embodiments, the guard members 102A-C are each vacuum formed. According to some embodiments, the guard members 102A-C are each monolithic.

According to some embodiments, the guard members 102A-C are formed of a material having a secant modulus in the range of from about 10,000 to 25,000 psi. According to some embodiments, the guard members 102A-C are formed of a material having a tensile strength in the range of from about 1450 to 2500 psi.

According to some embodiments, the guard members 102A-C are formed of a material having a hardness of at least about 35 Shore D and, in some embodiments, in the range of from about 25 to 75 Shore D.

The wall members 170A-C may be formed of any suitable electrically insulative material. According to some embodiments, the wall members 170A-C are formed of a flexible polymeric material. According to some embodiments, the wall members 170A-C are formed of a flexible polymeric material selected from the group consisting of flexible rubbers. According to some embodiments, the wall members 170A-C are formed of a rubber material selected from the group consisting of EPDM, silicone rubber, natural rubber, and neoprene. According to some embodiments, the wall members 170A-C are formed of a track resistant, insulating grade, UV stable polymer.

According to some embodiments, the wall members 170A-C are each unitarily and integrally formed. According to some embodiments, the wall members 170A-C are each unitarily molded. According to some embodiments, the wall members 170A-C are each unitarily injection molded. According to some embodiments, wall members 170A-C are each monolithic.

According to some embodiments, the base wall members 170A-C are formed of a material having a secant modulus in the range of from about 200 to 5000 psi. According to some embodiments, the base wall members 170A-C are formed of a material having a tensile strength in the range of from about 100 to 1500 psi.

According to some embodiments, the base wall members 170A-C are formed of a material having a hardness of less than or equal to about 40 Shore A and, in some embodiments, in the range of from about 20 to 70 Shore A.

According to some embodiments, the base wall members 170A-C are formed of a less rigid material than the guard members 102A-C. According to some embodiments, the base wall members 170A-C are formed of a softer material than the guard members 102A-C. In particular, in some embodiments, the base wall members 170A-C are formed of a relatively soft rubber and the guard members 102A-C are formed of a relatively rigid plastic.

According to some embodiments, the base wall members 170A-C are formed of a material having a hardness less than or equal to 70 Shore A and the guard members 102A-C are formed of a material having a hardness of at least 25 Shore D.

According to some embodiments, the base wall members 170A-C are formed of a material having a secant modulus at least 5000 psi less than the secant modulus of the material from which the guard members 102A-C are formed. According to some embodiments, the base wall members 170A-C are formed of a material having a tensile strength at least 650 psi less than the tensile strength of the material from which the guard members 102A-C are formed.

With reference to FIGS. 6 and 8, the wildlife guard apparatus 100 may be mounted on the electrical cable termination 11 in the following manner in accordance with embodiments of the present invention.

The electrical cable termination 11 is merely exemplary. With reference to FIG. 8, the electrical cable termination 11 includes an electrically conductive terminal connector 26 and an electrically insulating, tubular weathering sleeve 30. The sleeve 30 forms the outer surface and outer layer of the electrical termination 11 and the insulator body 10. An electrical conductor 28 of an electrical cable 24 extends through the sleeve 30 and is electrically and mechanically coupled to the terminal connector 26 from below. A second electrical conductor 20 is electrically and mechanically coupled to the terminal connector 26 from above. The insulating sleeve 30 surrounds a portion of the cable 24 and a lower portion of the terminal connector 26 to environmentally protect the cable 24 (e.g., from ingress of moisture). The sleeve 30 may be supported by the cable 24 and/or other components contained in the sleeve 30.

The sleeve 30 mounted on the cable 24 forms an insulator body 10 having a core 12. The sleeve 30 may be substantially cylindrical and fit snugly around the cable 24. The sleeve 30 further includes a plurality (as illustrated, four) of axially spaced apart skirts or sheds 14 extending radially outwardly from the core 12 and defining slots or gaps 16 therebetween.

The outer layer of the insulator body 10 (i.e., the sleeve 30) can be formed of any suitable electrically insulating material. According to some embodiments, the sleeve 30 has a secant modulus in the range of from about 200 to 750. According to some embodiments, the sleeve 30 is formed of a material having a tensile strength in the range of from about 650 to 3000 psi. According to some embodiments, the sleeve 30 is formed of an elastomeric material. According to some embodiments, the sleeve 30 is formed of ethylene propylene diene monomer (EPDM), liquid silicone rubber (LSR), ethylene propylene rubber (EPR), neoprene, silicone rubber, or other suitable rubber.

The wildlife guard apparatus 100 is assembled by connecting (e.g., by snap-fitting) the male hinge features 122 of the guard member 102B with the female hinge features 124 of the guard member 102C, and also connecting the female hinge features 124 of the guard member 102B with the male hinge features 122 of the guard member 102A. In this manner, hinges 120 are formed between the guard member 102A and the guard member 102C that securely connect the guard members 102A-C and permit adjacent ones of the guard members 102A-C to pivot with respect to one another about the axes A-A (FIG. 2) of the hinges 120. The guard members 102A-C may be assembled in this manner in a factory, in a shop, or in the field by an installer or other technician.

The base wall members 170A-C may be installed on the respective guard members 102A-C before or after connecting the guard members 102A-C to one another. In some embodiments, the guard assemblies 101A-C are each pre-assembled in a factory.

As shown in FIG. 6, the wildlife guard apparatus 100 may be lifted and positioned on or adjacent the insulator body 10. The installer can lift the wildlife guard apparatus 100 and laterally push (i.e., in a direction transverse or perpendicular to the axes of the hinges 120) the base wall member 170C of the guard assembly 101C, for example, axially between two selected skirts 14 of the insulator body 10.

Once the wildlife guard apparatus 100 is so positioned, the guard member 102C can be held in place while the guard member 102B is forced to rotate about the pivot axis A-A of the hinges 120 between the guard members 102B and 102C and about the core 12. The guard member 102A is forced to rotate about the pivot axis A-A of the hinges 120 between the guard members 102B and 102A and about the core 12 until the guard member 102A achieves the installed or closed position of FIG. 7 and the female hinge features 124 of the guard member 102A are connected or secured by latching or snap-fitting onto the male hinge features 122 of the guard member 102C.

In the closed position, the guard members 102A-C collectively form a lower end opening 117. The base wall members 170A-C collectively form an annular base wall 180 extending radially inwardly from the flanges 116 and across the opening 117, and encircling the core 12. The inner edges 174B of the base wall members 170A-C collectively define a base opening 184 and a surrounding seat 182 adjacent the core 12. A first portion 10B of the insulator body 10 extends through the end opening 117, adjacent the base wall 180, and through the base opening 184. The wall members 170A-C of the guard assemblies 101A-C reside inserted in the slot 16 between the selected skirts 14 to prevent vertical removal of the wildlife guard apparatus 100 from the insulator body 10. According to some embodiments, the installed wildlife guard apparatus 100 is substantially coaxial with the insulator body 10. According to some embodiments, the wildlife guard apparatus 100 substantially fully encircles the insulator body 10.

The shell bodies collectively form a hollow body or enclosure defining an interior chamber 160 that contains a second portion 10A of the insulator body 10 and, if present, the conductor 20. The adjacent notches 132 collectively define side conductor ports 132A through which the conductor 20 may exit the chamber 160. The outer notches 134 collectively define a top or outer conductor port 134A through which the conductor 20 may exit the chamber 160. The deflectable walls 142, 144 cover the ports 132A, 134A to inhibit entry of animals, debris or the like into the chamber 160.

According to some embodiments, the inner diameter of the base opening 184 when the wildlife guard apparatus 100 is closed is in the range of from about 1 to 4 inches.

According to some embodiments, the inner diameter of the base opening 184 when the wildlife guard apparatus 100 is closed is less than about 0.5 inch greater than the outer diameter of portion of the core 12 surrounded by the base wall 180.

In some embodiments, the base wall 180 engages the core 12. In some embodiments, the base wall 180 fits in contact with and snugly about the core 12 (i.e., the fingers 174 bear against the core 12 around the full circumference thereof). In some embodiments, the fingers 174 are resiliently or elastically deflected by the core 12.

According to some embodiments, the outer layer of the insulator body 10 (i.e., the sleeve 30) is formed of a material having a hardness less than the hardness of the guard members 102A-C. According to some embodiments, the outer layer of the insulator body 10 is formed of a material having a hardness greater than the hardness of the base wall members 170A-C. According to some embodiments, the outer layer of the insulator body 10 is formed of a material having a hardness less than the hardness of the guard members 102A-C and greater than the hardness of the base wall members 170A-C.

According to some embodiments, outer layer of the insulator body 10 (i.e., the sleeve 30) is formed of a material having a hardness of less than or equal to about 25 Shore A and, in some embodiments, in the range of from about 15 to 25 Shore A.

In other applications and embodiments, the outer layer of the insulator body 10 may be formed of a material that is harder than that of the guard members 102A-C. For example, in some embodiments, the insulator body 10 is a rigid insulator bushing formed of porcelain or other rigid, electrically insulating material. The rigid insulator bushing may include a substantially cylindrical core with a plurality of axially spaced apart skirts or sheds extending radially outwardly from the core and defining slots or gaps therebetween. The insulator bushing may include an oil level indicator (e.g., a sight glass) by which an operator can visually determine the level of oil in the bushing.

The wildlife guard apparatus 100 may be used with other types of insulator bodies such as those forming an outer layer or outer housing of surge arrestors, switch insulators, or support insulators. It will be appreciated that the outer surfaces or layers of these other insulator bodies may have properties relative to those of the base wall members 170A-C and the guard members 102A-C as discussed above with regard to the insulator body 10 and outer sleeve 30 (e.g., formed of a material that is softer than that of the guard members 102A-C and as hard as or harder than the material of the base wall members 170A-C).

The provision of materials of different hardnesses for the guard members 102A-C and the base wall members 170A-C provides substantial advantages. It is desirable or necessary to form the guard members 102A-C of a rigid, relatively hard material in order for the guard members 102A-C and the wildlife guard apparatus 100 to maintain their shapes and withstand various forces that they may experience in service, without bending, collapsing or the like. For example, the guard members 102A-C may be subjected to wildlife resting thereon or high winds. However, where the core 12 of the insulator body 10 is formed of a relatively soft material (e.g., a soft polymeric material), if the fingers 174 were formed of the rigid, hard material of the guard members 102A-C, the fingers 174 would tend to cut or gouge out the polymeric material of the core 12 in service. Over time, this damage to the core 12 may cause a failure of the insulator body 10.

According to some embodiments, a modular system is provided including a plurality of guard assemblies as described herein that can be selectively assembled or connected to one another to form wildlife guard apparatuses of different sizes or configurations by incorporating more or fewer of the guard assemblies in the assembled wildlife guard apparatus. According to some embodiments, the system includes at least four such guard assemblies so that an installer or technician can construct either the three-guard assembly wildlife guard apparatus or a larger four-guard assembly wildlife guard apparatus. According to some embodiments, the modular system is provided as a kit including the plurality of guard assemblies from which the technician can select the required number of guard assemblies for assembly. The unassembled guard assemblies of the kit may be suitably packaged for delivery, storage and/or handling.

In use, the technician can determine the size (e.g., core or skirt diameter) of the insulator body (e.g., cable termination sleeve or bushing) and, based on the determined size, select the appropriate number of the guard assemblies to include in the wildlife guard apparatus. The modular system may include a guide or instructions (e.g., provided with or packaged in the kit) that identify the number of guard assemblies needed for insulator bodies in different size ranges and/or of different types.

The modular system can provide improved flexibility in constructing and installing wildlife guards on insulator bodies of various different sizes. A technician can configure the wildlife guard apparatus as needed and, according to some embodiments, without requiring any special tools. Because the guard members are identical or the same or compatible in functional structure (e.g., have a hermaphroditic connector configuration), the utility and the technician only need to keep one type of guard member in their field storage or inventory, thereby reducing the cost and volume of required inventory.

The window openings 130 permit a technician to conveniently visually observe the insulator body 10. For example, the technician can observe whether an electrical cable termination or arrestor is damage or an oil level of a porcelain insulator bushing.

While the guard members 102A-C have been described herein as each movable (e.g., pivotable) relative to the other, two or more of the guard members 102A-C may be fixedly connected with at least one of the guard members 102A-C being movable relative to the others to permit insertion of the insulator body and subsequent closure thereabout.

Figure 9:
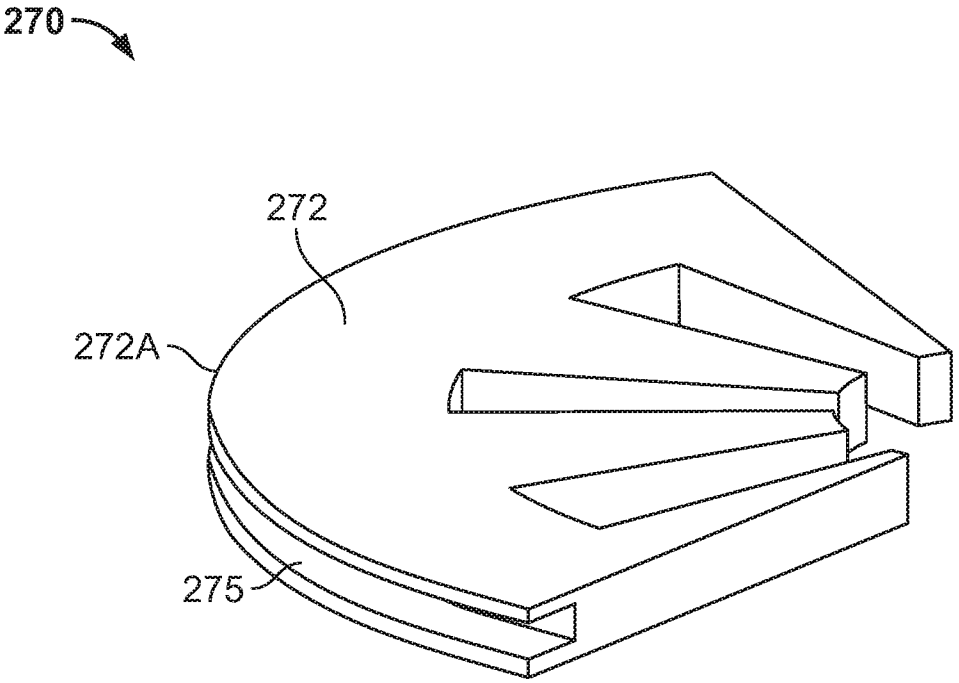
FIG. 9 is a top, front perspective view of an alternative base member for forming a part of the wildlife guard apparatus.

With reference to FIG. 9, an alternative base wall member 270 according to further embodiments of the invention is shown therein. One or more of the wall members 270 may be used in place of the base wall members 170A-C in the wildlife guard apparatus 100.

The base wall member 270 differs from the base wall member 170B in that a peripheral groove 275 is formed in the outer edge 272A of the body 272. The base wall member 270 is secured to the respective guard member 102B by inserting the flange 116 into the groove 275 such that the flange 116 is firmly seated therein. The base wall member 270 may be retained on the flange 116 by friction fit, a bonding agent (e.g., adhesive), or welding, for example.

The base wall members (e.g., base wall members 170A-C or 270) may be affixed to the guard members (e.g., guard members 102A-C) by any suitable technique. In some embodiments, the base wall member is bonded (e.g., by adhesive) or welded to the guard member. In some embodiments, the base wall member is affixed to the guard member by fasteners such as screws, bolts or rivets. In some embodiments, the base wall member is affixed to the guard member by molding (e.g., co-molding or insert molding). In some embodiments, the base wall member is secured to the guard member by integral interlock features on one or both of the base wall member and the guard member. The base wall member may be secured to the guard member by two or more of the foregoing techniques in combination.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A wildlife guard apparatus for an electrical insulator body, the wildlife guard apparatus comprising:

a plurality of guard assemblies, each of the guard assemblies including a guard member and a base wall member secured to the guard member of said each of the guard assemblies;

wherein the plurality of guard assemblies is configured or configurable to form an enclosure defining a chamber, wherein in the enclosure configuration the plurality of guard assemblies defines an end opening communicating with the chamber and the base wall members extend across the end opening to close at least a portion thereof and define a base opening and a surrounding seat;

wherein the enclosure is configured to receive the insulator body such that the insulator body includes a first portion and a second portion, the first portion extending through the end opening, adjacent the base wall members and through the base opening, and the second portion being disposed in the chamber; and wherein the guard members are formed of a first material and the base wall members are formed of a second material that is softer than the first material.

2. The wildlife guard apparatus of claim 1 wherein the second material is less rigid than the first material.

3. The wildlife guard apparatus of claim 1 wherein the insulator body includes an outer surface formed of a third material, and the third material is softer than the second material.

4. The wildlife guard apparatus of claim 1 wherein:

the insulator body includes a core and a plurality of skirts spaced apart along a length of the core, the skirts extending radially outwardly from the core; and the base wall members are configured to be received between adjacent ones of the skirts when the wildlife guard apparatus is mounted on the insulator body in the enclosure configuration.

5. The wildlife guard apparatus of claim 1 wherein:

the guard members of the plurality of guard assemblies are serially connected to one another such that at least one of the guard members is moveable relative to the others; and the guard members are selectively movable between an open position, wherein the plurality of guard assemblies is configured to receive the insulator body, and a closed position, wherein the plurality of guard assemblies collectively forms the enclosure, the plurality of guard members collectively forms the end opening, and the base wall members of the guard assemblies collectively form the base wall extending across the end opening.

6. The wildlife guard apparatus of claim 5 wherein the plurality of guard assemblies includes at least three guard assemblies.

7. The wildlife guard apparatus of claim 5 wherein each of the guard members has a respective shell body, and the shell bodies collectively define the chamber when the plurality of guard assemblies is in the closed position.

8. The wildlife guard apparatus of claim 5 wherein the base wall is annular.

9. The wildlife guard apparatus of claim 8 wherein:

the insulator body includes a core and a plurality of skirts spaced apart along a length of the core, the skirts extending radially outwardly from the core; and the base wall is configured to be received between adjacent ones of the skirts when the plurality of guard members is in the closed position.

10. The wildlife guard apparatus of claim 1 wherein the second material is a rubber.

11. The wildlife guard apparatus of claim 1 wherein the second material has a hardness less than or equal to 70 Shore A and the first material has a hardness of at least 25 Shore D.

12. The wildlife guard apparatus of claim 1 wherein the second material has a tensile strength at least 650 psi less than the tensile strength of the first material.

13. The wildlife guard apparatus of claim 1 wherein the second material has a secant modulus at least 5000 psi less than the secant modulus of the first material.

14. A method for covering an electrical insulator body, the method comprising:

providing a wildlife guard apparatus including:

a plurality of guard assemblies, each of the guard assemblies including a guard member and a base wall member secured to the guard member of said each of the guard assemblies;

wherein the plurality of guard assemblies is configured or configurable to form an enclosure defining a chamber, wherein in the enclosure configuration the plurality of guard assemblies defines an end opening communicating with the chamber and the base wall members extend across the end opening to close at least a portion thereof and define a base opening and a surrounding seat; and mounting the enclosure on the insulator body such that the insulator body includes a first portion extending through the end opening, adjacent the base wall members and through the base opening and a second portion disposed in the chamber;

wherein the guard members are formed of a first material and the base wall members are formed of a second material that is softer than the first material.

15. The method of claim 14 wherein the second material is less rigid than the first material.

16. The method of claim 14 wherein the insulator body includes an outer surface formed of a third material, and the third material is softer than the second material.

17. The method of claim 14 wherein:

the insulator body includes a core and a plurality of skirts spaced apart along a length of the core, the skirts extending radially outwardly from the core; and mounting the enclosure on the insulator body includes mounting the enclosure on the insulator body in the enclosure configuration such that the base wall members are received between adjacent ones of the skirts.

18. The method of claim 14 wherein:

the guard members of the plurality of guard assemblies are serially connected to one another such that at least one of the guard members is moveable relative to the others; and the method includes selectively moving the guard members between an open position, wherein the plurality of guard assemblies is configured to receive the insulator body, and a closed position, wherein the plurality of guard assemblies collectively forms the enclosure, the plurality of guard members collectively forms the end opening, and the base wall members of the guard assemblies collectively form the base wall extending across the end opening.

19. The method of claim 18 wherein each of the guard members has a respective shell body, and the shell bodies collectively define the chamber when the plurality of guard assemblies is in the closed position.

20. The method of claim 18 wherein the base wall is annular.

21. The method of claim 20 wherein:

the insulator body includes a core and a plurality of skirts spaced apart along a length of the core, the skirts extending radially outwardly from the core; and mounting the enclosure on the insulator body includes mounting the enclosure on the insulator body in the closed position such that the base wall is received between adjacent ones of the skirts.

22. The method of claim 14 wherein:

the second material is a rubber;

the second material has a hardness less than or equal to 70 Shore A and the first material has a hardness of at least 25 Shore D;

the second material has a tensile strength at least 650 psi less than the tensile strength of the first material; and the second material has a secant modulus at least 5000 psi less than the secant modulus of the first material.

23. A protected electrical equipment installation comprising:

an electrical insulator body; and a wildlife guard apparatus including:

a plurality of guard assemblies, each of the guard assemblies including a guard member and a base wall member secured to the guard member of said each of the guard assemblies;

wherein the plurality of guard assemblies is configured or configurable to form an enclosure defining a chamber, wherein in the enclosure configuration the plurality of guard assemblies defines an end opening communicating with the chamber and the base wall members extend across the end opening to close at least a portion thereof and define a base opening and a surrounding seat;

wherein the enclosure is mounted on the insulator body such that the insulator body includes a first portion extending through the end opening, adjacent the base wall members and through the base opening and a second portion disposed in the chamber; and wherein the guard members are formed of a first material and the base wall members are formed of a second material that is softer than the first material.

24. The protected electrical equipment installation of claim 23 wherein the insulator body includes an outer surface formed of a third material, and the third material is softer than the second material.

25. The protected electrical equipment installation of claim 23 wherein:

the insulator body includes a core and a plurality of skirts spaced apart along a length of the core, the skirts extending radially outwardly from the core; and the at least one base wall member is received between adjacent ones of the skirts.

* * * * *